US008066576B2

(12) United States Patent
Threlkel

(10) Patent No.: US 8,066,576 B2
(45) Date of Patent: Nov. 29, 2011

(54) AMUSEMENT RIDE

(76) Inventor: David V. Threlkel, Calabasas, CA (US)

( * ) Notice: Subject to any disclaimer, the term of this patent is extended or adjusted under 35 U.S.C. 154(b) by 0 days.

(21) Appl. No.: 12/357,392

(22) Filed: Jan. 21, 2009

(65) Prior Publication Data

US 2009/0126596 A1 May 21, 2009

Related U.S. Application Data

(63) Continuation of application No. 10/396,178, filed on Mar. 24, 2003, now abandoned.

(60) Provisional application No. 60/367,051, filed on Mar. 22, 2002.

(51) Int. Cl.
*A63G 31/06* (2006.01)
*A63G 31/00* (2006.01)

(52) U.S. Cl. ..... 472/47; 472/131; 104/53

(58) Field of Classification Search ..... 472/29, 472/39, 47, 49, 50, 131; 104/53, 77, 78
See application file for complete search history.

(56) References Cited

U.S. PATENT DOCUMENTS

| | | | | |
|---|---|---|---|---|
| 2,535,862 | A | 12/1950 | Pewitt | |
| 4,170,943 | A | 10/1979 | Achrekar | |
| 5,060,932 | A | 10/1991 | Yamaguchi | |
| 5,725,435 | A * | 3/1998 | De Castro Faria | 472/47 |
| 5,759,107 | A * | 6/1998 | Nagel | 472/47 |
| 6,220,171 | B1 * | 4/2001 | Hettema et al. | 104/53 |
| 6,755,749 | B2 * | 6/2004 | Stengel | 472/50 |
| 6,808,459 | B2 * | 10/2004 | Checketts | 472/118 |

FOREIGN PATENT DOCUMENTS

JP A-1-285286 11/1989

* cited by examiner

*Primary Examiner* — Kien Nguyen

(57) ABSTRACT

An amusement ride, such as a roller coaster or vertical tower track ride, includes an attachment assembly movably connected to a track system. A vehicle assembly is connected to the attachment assembly and includes a seat assembly having at least one rider seat. The vehicle assembly is coupled to the attachment assembly and configured such that the seat assembly is capable of fully rotating about first and second, and preferably even third axes independent of the track system.

10 Claims, 18 Drawing Sheets

AMUSEMENT RIDE

RELATED APPLICATION

This application claims priority to U.S. Provisional Application Ser. No. 60/367,051, filed Mar. 22, 2002.

This application is a continuation from U.S. patent application Ser. No. 10/396,178, filed Mar. 24, 2003 now abandoned The present invention generally relates to amusement rides. More particularly, the present invention relates to amusement rides which allow free or controlled rotation of the rider in multiple planes to enhance and vary the ride experience.

Roller coasters have long been some of the well liked rides in amusement parks. Roller coasters normally have an endless track loop. Riders load and unload at a platform or station, typically at a low elevation. At the beginning of each ride cycle, a roller coaster car or a train of cars is generally towed or moved up a relatively steep incline of an initial track section to the highest point on the entire track. The car is then released from the high point and gains kinetic energy, which allows the car to travel entirely around the track circuit or loop, and return back to the loading/unloading station. The roller coaster track typically includes various loops, turns, inversions, cork screws and other configuration intended to thrill the riders.

Since the early days of roller coasters, people have experimented with variations of a central theme, which is to provide amusement to riders seated inside cars which travel long tracks. Traditional roller coasters travel along rail tracks and provide their riders with stationery seats or harnesses which fix the motion of the riders to the direction of travel of the cars.

The overall effect attained by traditional roller coasters is to statically couple riders to the cars and therefore sense essentially the same motions in gravitational forces experienced by the cars in which they ride. This problem is experienced by most amusement rides, which due to the static nature of the ride provides the same ride sensation and experience every time it is ridden. Such amusement devices also fail to provide for free fall, retrograde motion or helical motion.

Some amusement devices, including roller coasters, attempt to deliver additional systems of rotation other than the movement of the vehicle on the track system. Examples of amusement rides which provide some rotation capabilities with or without passenger control are U.S. Pat. No. 4,545,574 to Sassak, U.S. Pat. No. 4,501,434 to Dupuis, U.S. Pat. No. 4,170,943 to Acrekar, U.S. Pat. No. 6,302,029 to Distelrath, U.S. Pat. No. 6,158,354 to Masahide, and various patents to Mares including U.S. Pat. Nos. 5,791,254, 6,098,549 and 6,227,121.

Unfortunately, these known rides are limited in their abilities and functions. Many of the roller coasters do not have the ability for a user to rotate in a direction or dimension independent from the track. Further, many rides are not able to rotate or spin in a controlled manner. Moreover, many such amusement rides only partially rotate in a given axis, or only fully rotate in one or two axes—thus the ride is not truly a full range motion ride. In fact, the inventor is not aware of any amusement ride which allows rotation in all three planes, namely the roll, pitch and yaw axes.

Accordingly, there is a continuing need for an amusement ride which provides full rotation of the riders in at least two planes or axes, and preferably three. What is further needed is an amusement ride which is not static, but rather the movement and rotation of the vehicles or riders can be varied from ride to ride. The present invention fulfills these needs and provides other related advantages.

SUMMARY OF THE INVENTION

The present invention resides an amusement ride, such as a roller coaster or a vertical track ride, which enables full rotation in at least two planes or axes, and preferably all three planes or axes.

The amusement ride generally comprises a track system, which may be an endless roller track or at least one vertical tower track. An attachment assembly, such as a bogey, is movably connected to the track system. A vehicle assembly is connected to the attachment assembly and includes a seat assembly having at least one rider seat. The vehicle assembly includes means for fully rotating the seat assembly about first, second and third axes independent of the track system, and preferably independent of one another.

In one embodiment, the vehicle system includes a first arm extending from the attachment assembly and operably coupled to an actuator such that the first arm is freely or selectively rotatable about a first axis. The first arm may comprise a generally semi-circular arm attached to a yaw actuator whereby yaw rotation is imparted to the arm. Alternatively, the first arm comprises a shaft extending from the attachment assembly and coupled to a yaw actuator. A second arm is rotatably connected to the first arm by an actuator such that the second arm is freely or selectively rotatable about a second axis independent of the first arm. Typically, the second arm extends generally transverse from an end portion of the first arm and supports at least one seat assembly. A roll actuator is operably connected to each seat assembly such that roll rotation is imparted to the seat assembly. Thus, the seat assembly is capable of yaw, pitch, and roll rotations over all three axes.

In another embodiment, the vehicle assembly comprises a generally circular main ring housing that is rotatably connected to the attachment assembly. Typically, a yaw gear of a gear assembly interconnects the attachment assembly and the vehicle assembly whereby yaw rotation is imparted to the main ring housing, and thus the seat assembly. A pitch arm extends between opposing sides of the main ring housing and supports the seat assembly. The pitch arm is rotatable along a second axis independent of the track system. A gear of the pitch bar mates with a pitch gear of the gear assembly to impart such pitch rotation. A split inner race assembly including rollers is disposed within the main ring housing and connected to the pitch bar. The split inner race assembly is operably coupled to a roll gear of the gear assembly, whereby roll rotation is imparted to the split inner race assembly, and thus the seat assembly.

In yet another embodiment, the vehicle assembly comprises an arm extending from the attachment assembly, such as a semi-circular arm, which is rotationally coupled to a gyroscope assembly that supports the one or more seats of the seat assembly therein. The gyroscope structure or assembly comprises a first generally circular ring coupled to the semi-circular arm by an actuator that imparts rotation to it, and thus the seat assembly, about a first axis. A second generally circular ring is disposed within the first ring and is coupled thereto by an actuator that imparts rotation about a second axis. A third ring may be used which is disposed within the second ring and rotatably coupled to the second ring by an actuator that imparts rotation to the seat assembly about a third axis. Alternatively, the arm is rotatably coupled to the attachment assembly to provide the third degree of rotation.

The important aspect of the present invention is that the seats be fully rotatable in at least two, and preferably all three, planes or axes. Although such rotation may be free and dependent upon the change of acceleration placed upon the seat assembly, typically the actuators are mechanically driven or powered to selectively rotate the seat assembly. When powered, the rotation of the seat assembly may be altered by pre-defined programs or even rider control.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings

DETAILED DESCRIPTION OF THE PREFERRED EMBODIMENTS

As illustrated in the accompanying drawings for purposes of illustration, the present invention resides in an amusement ride wherein one or more riders sit and are restrained into a seat of a vehicle assembly which travels along a track system of either a roller coaster or a vertical tower-type ride. The vehicle assemblies of the present invention are designed and configured such that the seats thereof rotate along at least two axes, and preferably three axes, independent of the track system. As will be more fully described herein, although such rotation can be dependent upon acceleration forces exerted on the seats and vehicle assembly, typically such rotation is controlled either by mechanical systems linked to the track, or more preferably through actuators on the vehicle assembly itself. The use of actuators, such as electric motors, hydraulic motors, or pneumatic systems, enable the degree of rotation to be controlled and the ride to be non-static such that either the rider can determine the degree of "extremeness" of the ride experience, or the ride periodically re-programmed such that a different experience is given over time, and thus attracting more visitors to the ride.

Figure 1:
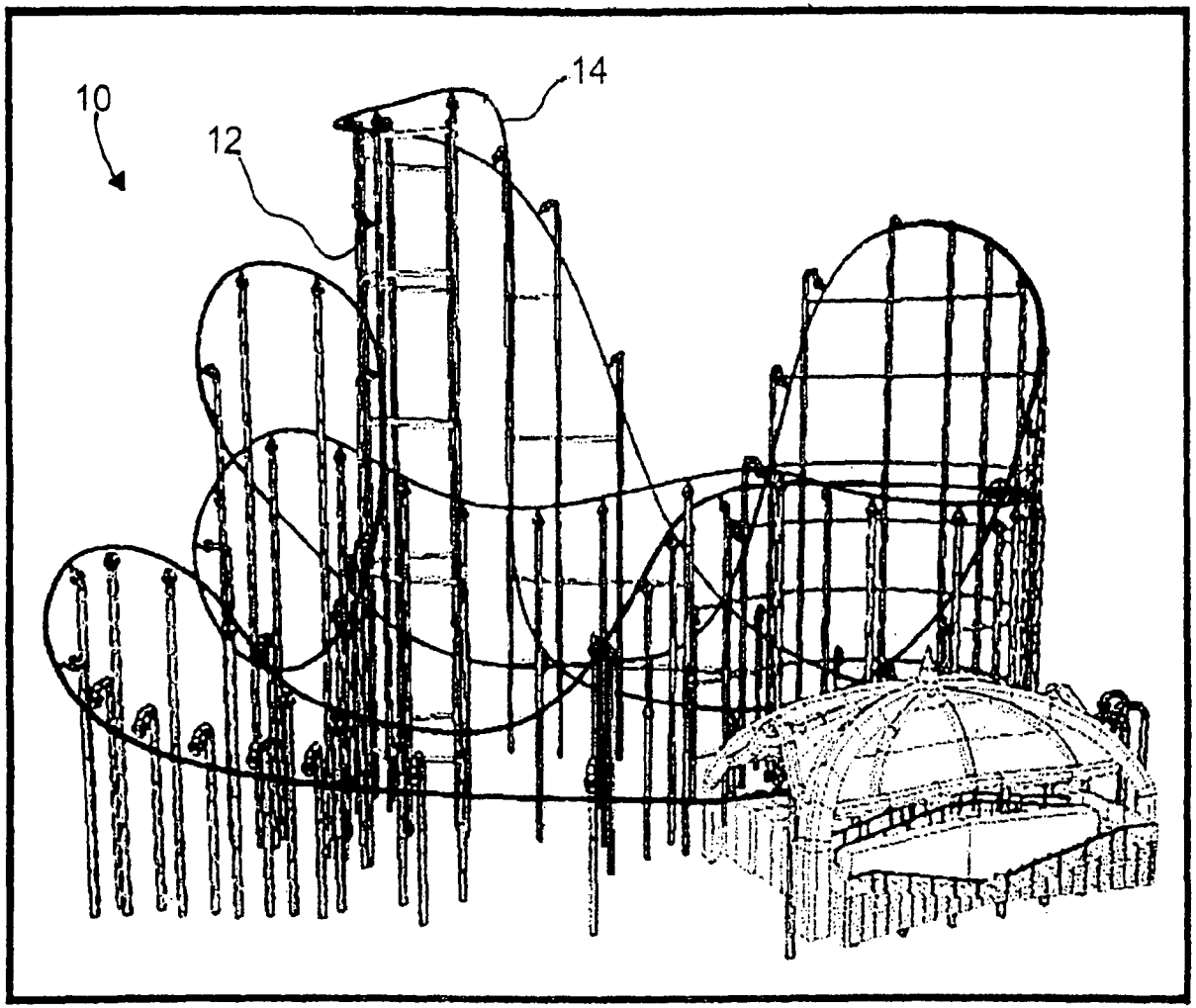
FIG. 1 is a representational view of a roller coaster track system which can support the present invention.

With reference to FIG. 1, the amusement ride system of the present invention is particularly adapted to roller coasters 10 such as that illustrated in FIG. 1. Such roller coasters comprise vertical supports 12, in the form of pylons or supporting beams and a track or rail 14 which is preferably made of steel or some other strong material and held together by the system of supporting beams 12, rings, rods and rails and the like. Typically, the track 14 will be varied in elevation so as to be suspended from the earth, and may include various twists, turns, corkscrews, etc. to enhance the effect of the ride experience.

Figure 2:
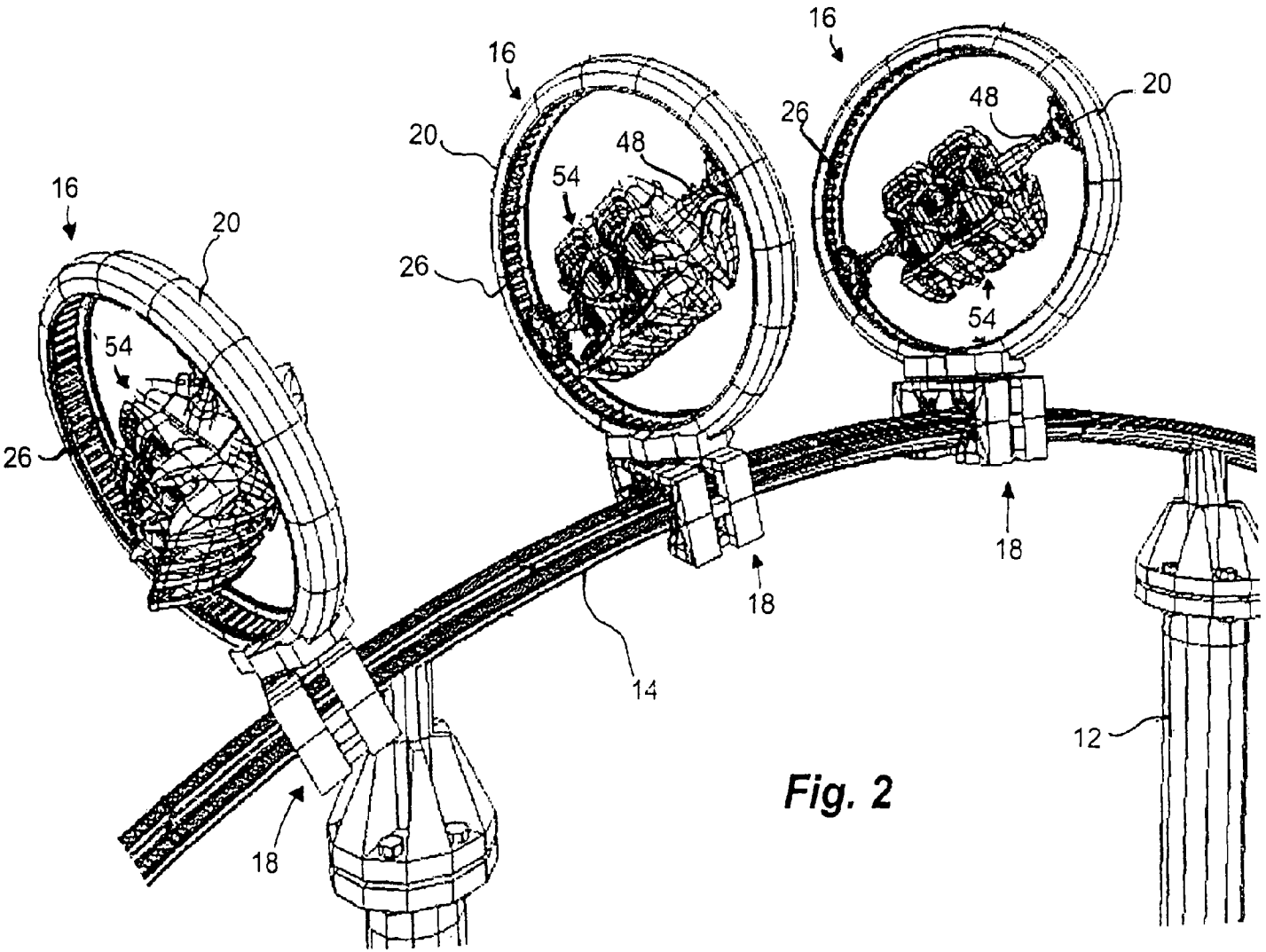
FIG. 2 is a partially fragmented perspective view of amusement ride devices embodying the present invention moving along a roller coaster track.

With reference now to FIGS. 2-6, a first preferred embodiment of the present invention is illustrated. As shown in FIG. 2, each vehicle assembly 16 embodying the present invention is linked to an attachment system 18 which is movably connected to the track system 14 of the roller coaster 10. The attachment system comprises a bogey or the like having wheels or rollers or other movement means which connect to the one or more rails of the track system 14 to enable movement thereon.

Propulsion of the vehicle assemblies 16 can be of the typical variety wherein the vehicle assemblies and attachment assemblies 16 and 18 are lifted to an apex of the roller coaster 10 and released so as to be powered by gravitational forces. However, propulsion can be accomplished in other manners including air blasts, spring, mechanical push devices, electromagnetic devices, or any other commonly used propulsion devices for such amusement rides.

Thus, the amusement rides, (i.e. roller coasters) of the present invention comprise at least three major elements. First, a track system 14. Second, the vehicle assembly 16 in which the user or rider rides. Third, an assembly 18 for linking or attaching the vehicle assembly 16 to the track system 14, such as a roller coaster bogey. The attachment assembly 18 can be separate from the track system 14 or vehicle assembly 16 or part of either or both. Typically, the attachment assembly 18 is operably connected to the track system 14 by wheels which allow a low friction travel of the vehicle assembly 16 while allowing the structure to retain the vehicle assembly 16 on the track 14. Although the vehicle assemblies 16 illustrated herein are shown as being suspended or inverted with respect to the track 14, it will be understood by those skilled in the art that the vehicle assemblies 16 can run over the track 14, or even hang from the side of the track 14.

The vehicle assembly 16 includes a first arm 20 extending from the attachment assembly 18 that serves to link the various components of the vehicle assembly 16 to the attachment assembly 18 and track 14. In the embodiment illustrated in FIGS. 2-6, this linkage arm 20 comprises a generally circular main ring housing. In a particularly preferred embodiment, the main ring housing 20 is rotatably connected to the bogey 18. As illustrated, this connection comprises a gear assembly 22 interconnected between the bogey and the vehicle assembly 16. The main ring housing 20 comprises opposing ring structures, as illustrated in FIG. 6. A yaw or thrust gear 24 is operably coupled to the main ring housing 20. This gear 24 makes contact with a pinion gear or the like which is driven by an actuator in a yaw axis. As illustrated, the individual gears of the gear assembly 22 would be operably coupled to a toothed rack or the like in order to create a rack and pinion mechanical system. Cam followers sector gears or the like placed on the track system 14 would interact with the rack or other similar structure in order to rotate the gear assembly 22. Alternatively, a pneumatic, hydraulic, or preferably an electric motor would be connected to the yaw gear 24 such that the main ring housing 20 would spin and rotate in the yaw direction.

Disposed and operatively connected within the main ring housing 20 is a split inner race 26 which comprises two circular pieces 28 and 30 which are spaced from one another and create a center divider. Within this divider are housed roll bearings 32 which are interconnected by bars 34 or the like. On one side of the split inner race 26 is a roll ring gear 36. The roll ring gear 36 makes operable contact with a beveled roll gear 38 of the gear assembly 22. The beveled roll gear 38 has a shaft extending upwardly therefrom to a roll spur gear 40. The roll spur gear 40 is operably connected to an actuator, such as a toothed rack, so that the beveled roll gear 38 rotates independently of the yaw gear 24. Thus, rotation of the roll spur 40 causes the inner race 26 to rotate in the roll direction.

Figure 3:
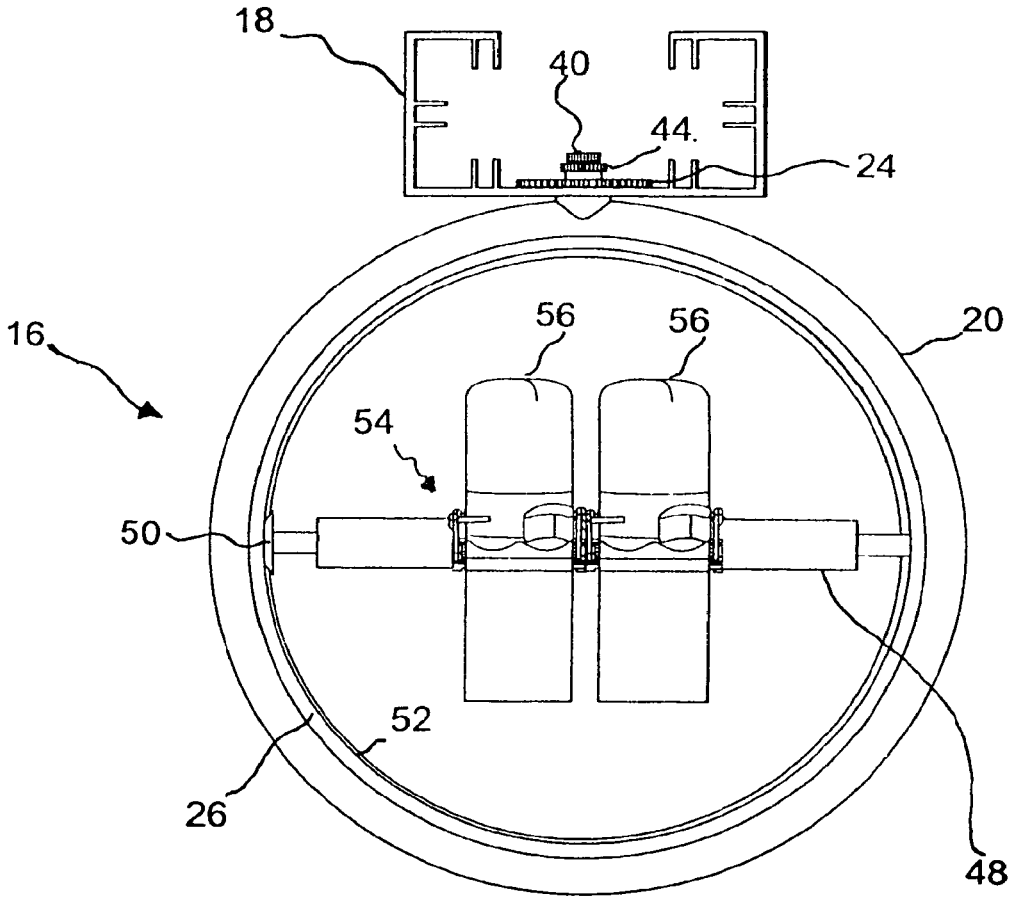
FIG. 3 is a front elevational view of an attachment assembly and vehicle assembly embodying the present invention.
Figure 4:
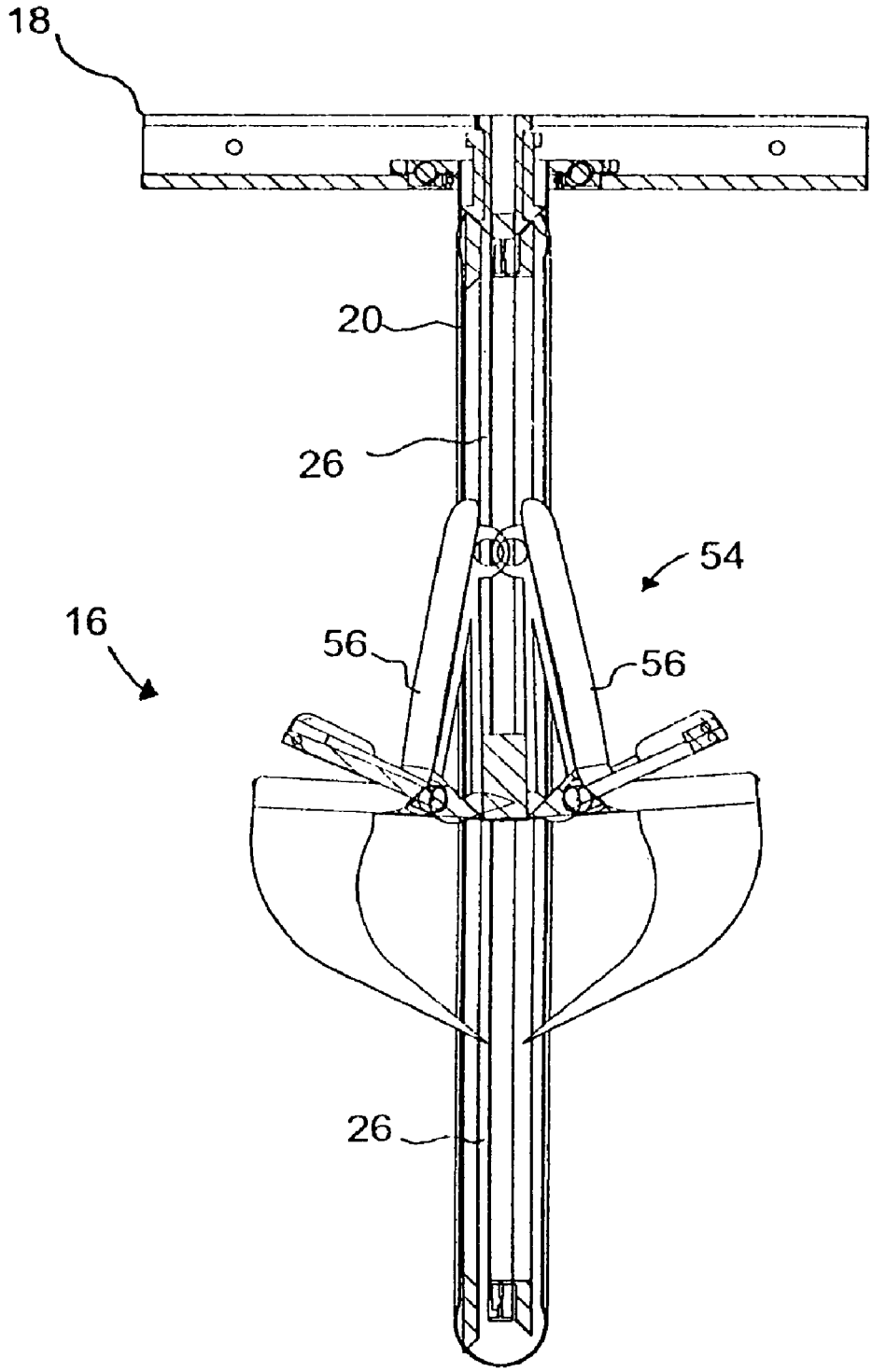
FIG. 4 is a side cross-sectional view of the vehicle assembly of FIG. 3.
Figure 5:
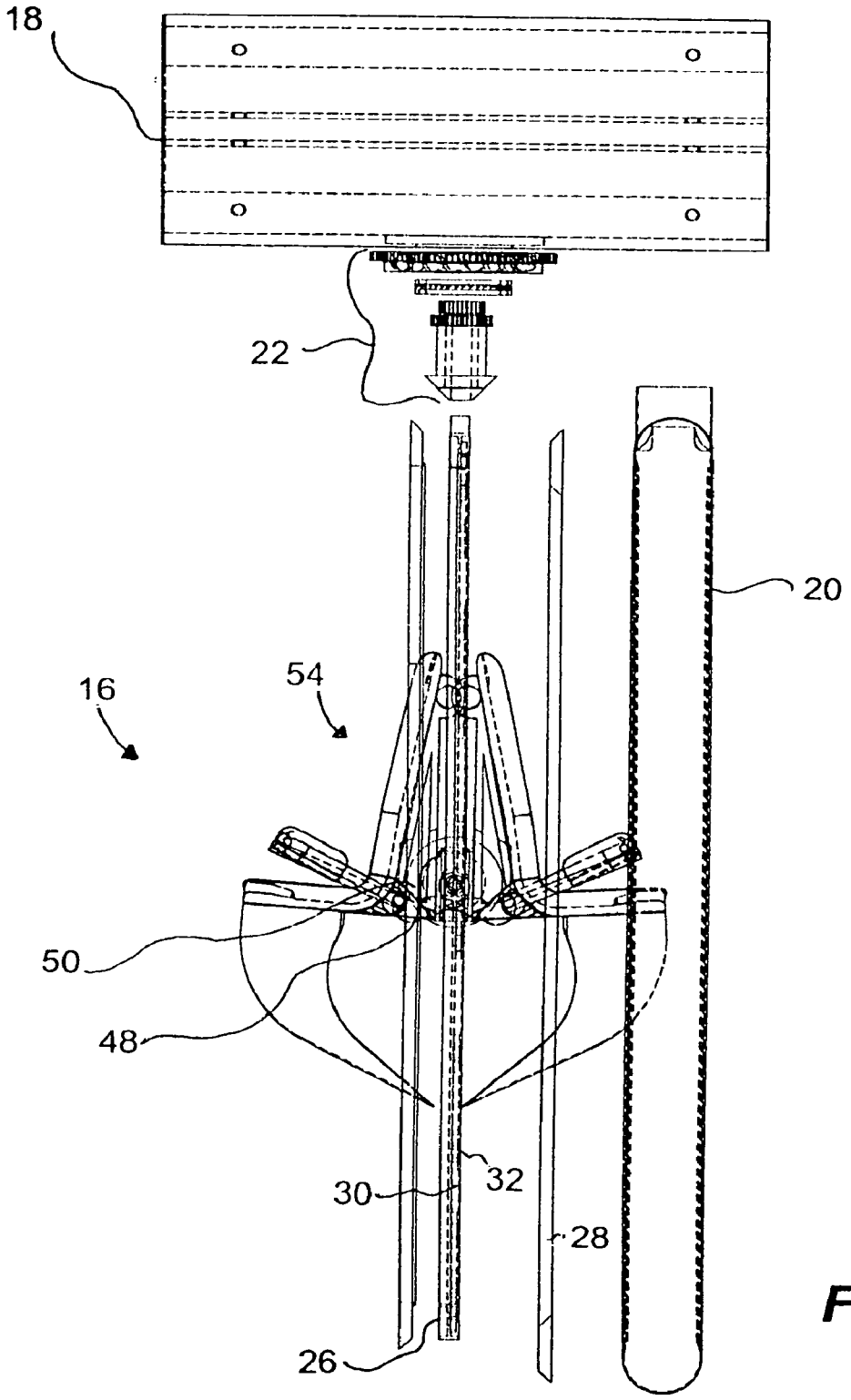
FIG. 5 is an exploded cross-sectional view illustrating the various components of the vehicle assembly of FIG. 4.
Figure 6:
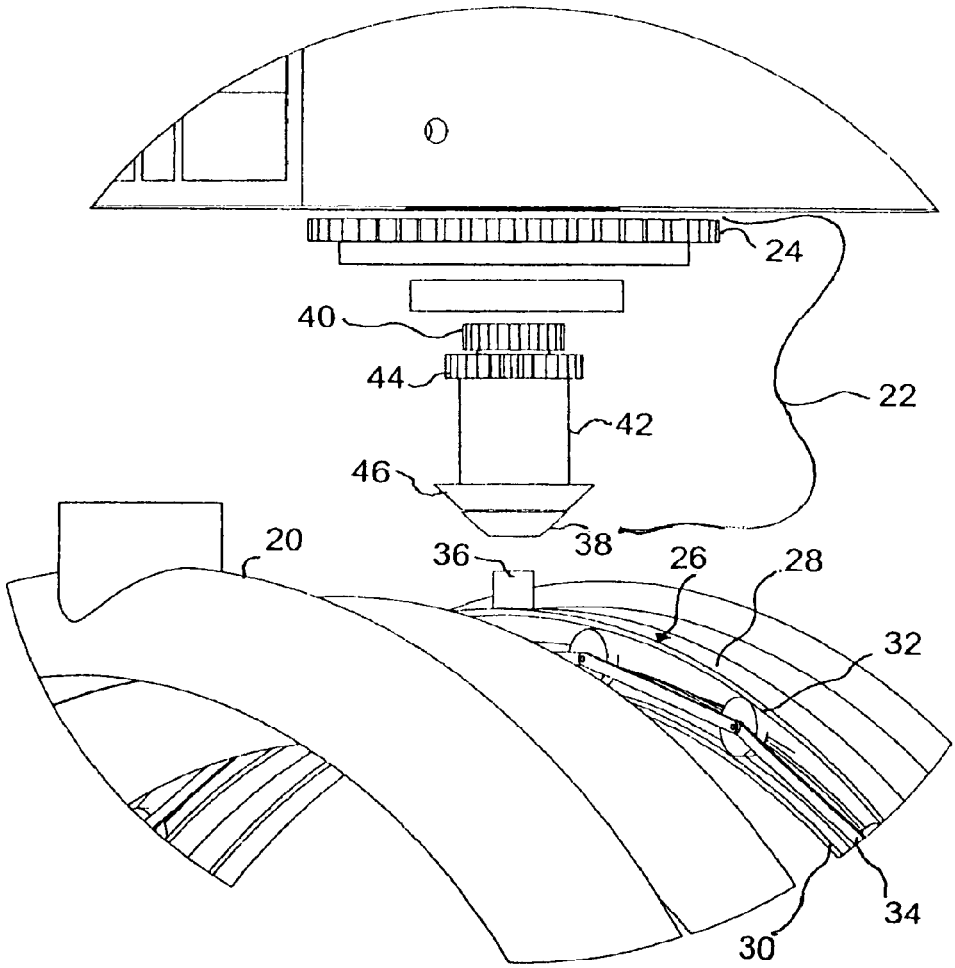
FIG. 6 is an enlarged and partially fragmented perspective view of an upper portion of the vehicle assembly of FIGS. 3-5, illustrating the connection of various gears of a gear assembly to components of the vehicle assembly to impart the desired rotation.

With continuing reference to FIGS. 5 and 6, the shaft of the roll gear is nested within a shaft 42 of a pitch gear. A pitched spur 44 is operably connected to an actuator, such as a toothed rack or pinion gear which selectively activate and rotate the pitch spur 44. A beveled pitch gear 46 is disposed at the opposite end of shaft 42 and turns a pitch ring gear (not shown). The pitch spur 44 and roll spur 40 extend upwardly through the yaw gear 24, as illustrated in FIG. 3, so that each is conveniently accessible to the necessary connection to be selectively rotated.

A pitch bar 48 extends between opposing sides of the main ring housing 20 such that rotation of the main ring housing 20 causes the pitch bar 48 to rotate in the yaw direction as well. The pitch bar 48 is connected to the inner race 26 such that roll rotation of the inner race 26 imparts a rotation of the pitch bar 48 in the rolled direction. An operable connection between the pitch bar 48 and the pitch ring gear is made, such as by the beveled pitch bar gear 50 at one end of the pitch bar 48 which operably contacts and engages a pitch ring 52 which serves as a gear, which is rotatably connected to the beveled pitch gear 46 of the gear assembly 22. Thus, rotational movement of the pitch gear 46 imparts a pitch rotation to the pitch bar 48.

A seat assembly 54 is attached to the pitch bar 48. The seat assembly 54 includes at least one, and preferably a plurality of clustered seats 56. Typically, the seat assembly 54 is disposed in the center of the vehicle assembly 16. The seat assembly 54, as illustrated, comprises four seats, a pair facing opposite directions such that riders experience a different viewing angle and ride experience merely by their placement within the seat assembly 54. The seat assembly 54 contains the necessary components for the comfort and safety of the rider. For example, head supports, seat cushions, leg supports, arm rests, etc. are provided as necessary. Any means of supporting the rider are contemplated by the present invention. Additionally, the present invention contains any suitable and necessary restraining systems known in the art. Such restraining systems may comprise bars or harnesses, such as a five-point harness.

In operation, each of the bogeys 18 and vehicle assemblies 16 are propelled along the track system 14. The vehicle assembly 16 may be formed in a linked train of a predetermined number of vehicle assemblies 16. As described above, typically the assemblies 18 and 16 would be lifted, by chain or otherwise, to an apex of the roller coaster system 10. Gravitational forces would then move the assemblies 16 and 18 throughout the track system 14. In the illustrated embodiment, cam followers or the like would interact with pinion gears, toothed racks, or the like in order to rotate the gears 24, 40 and 44 of the gear assembly 22, thus imparting the desired rotation to the seat assembly 54. The seat assembly 54 would be capable of yaw, roll and pitch rotation depending upon the actuation of the gears.

Although a mechanical system is contemplated by the invention, such would create a static ride experience for the rider. Thus, in a particularly preferred embodiment, actuators, such as electric motors, hydraulic motors, or pneumatic systems, would be mounted in convenient locations in the vehicle assembly 16 so as to cause yaw rotation of the main ring housing 20, roll rotation of the inner race 26, and pitch rotation of the pitch bar 48 so that the seat assembly 54 experiences these three degrees of rotation. Electric current could be supplied to the electric motor, pneumatic motor or hydraulic motor systems via brush contacts with slip rings or the like which are operably connected to electrical power via electrical wires positioned on or within the track system 14, or any means which are well known in the art. Such actuators would enable the rotation of the seat assembly 54 to be varied, such as by programming or placement of sensors on the track system 14.

The invention also contemplates that the rotatable connections described above could be free to move in response to changes in acceleration of the assembly 16. Dampers or brake mechanisms could be applied such that rotation could be somewhat controlled and not exceed dangerous limits. However, the present invention preferably utilizes the actuators described above so as to create controlled movement of the seat assembly 54 which can be altered from ride to ride or over time.

Figure 7:
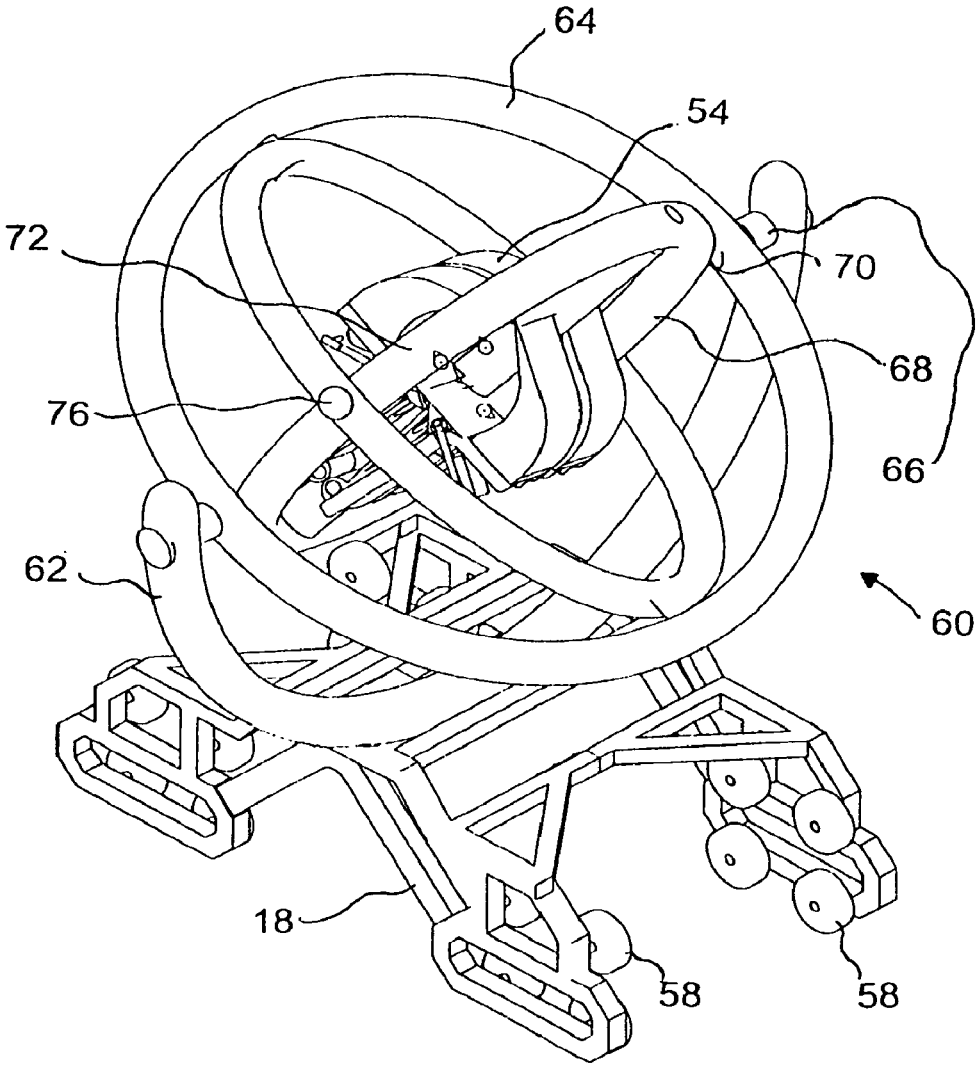
FIG. 7 is a perspective view of another attachment assembly and vehicle assembly embodying the present invention.
Figure 8:
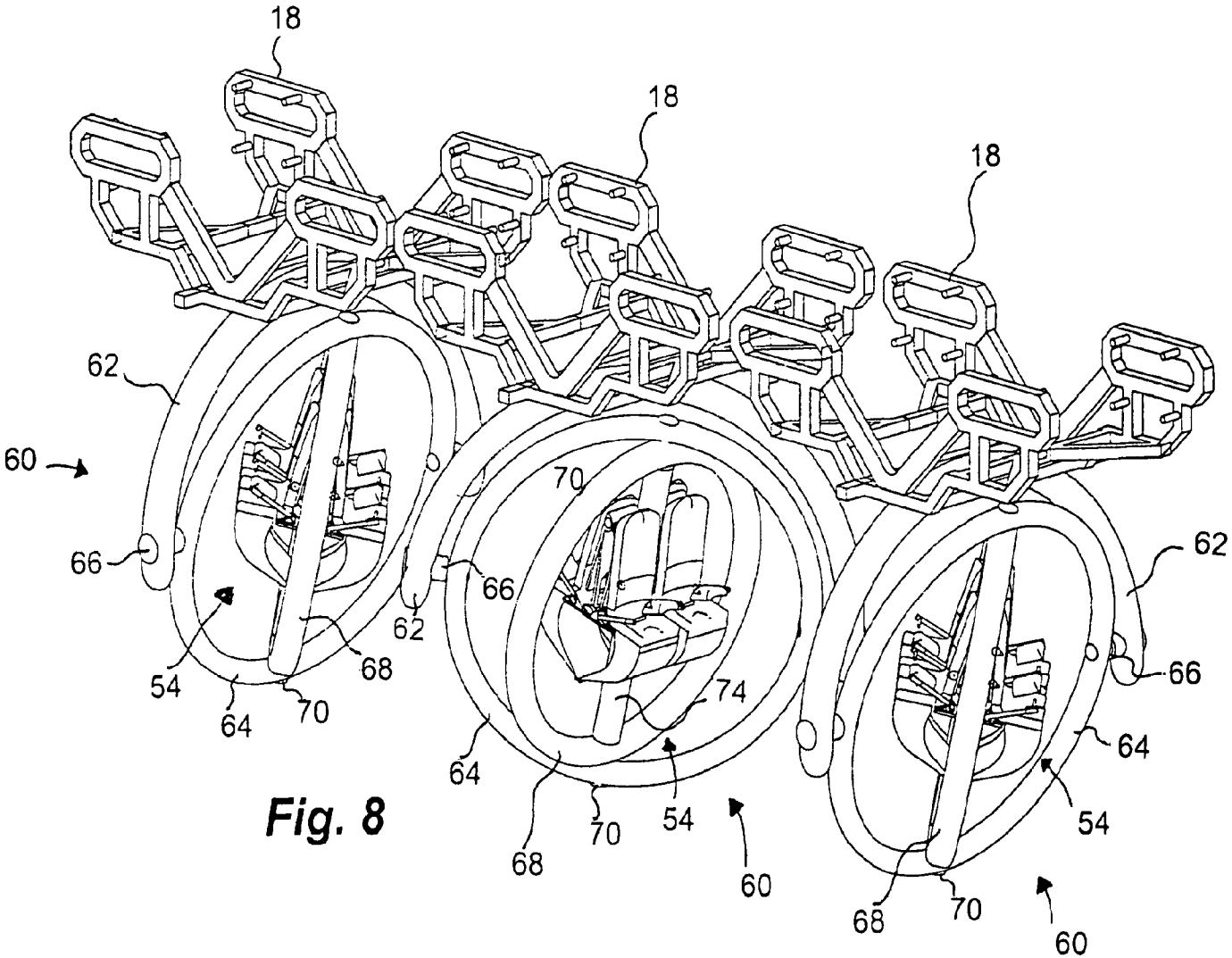
FIG. 8 is a perspective view of a train of such vehicle and attachment assemblies.

With reference now to FIGS. 7 and 8, another embodiment of the amusement ride of the present invention is illustrated. This embodiment also incorporates an attachment assembly 18, such as the illustrated bogey having opposing wheels 58 which are configured to engage the track system 14. A gyroscope-like vehicle assembly 60 extends from the bogey 18. The gyroscope assembly 60 is comprised of a linkage arm 62, which is typically semi-circular in shape that is either fixed or rotatably connected to the bogey 18. At least one, a preferably multiple rings are interconnected to the linkage arm 62. As illustrated, the linkage arm 62 is fixed to the bogey 18. A first ring structure 64 is rotatably connected to the lower ends of the linkage arm 62. Such rotatable connection is typically formed by an actuator 66, such as an electric servo or motor having a gear assembly operably interconnecting the arm 62 and ring 64 so as to impart rotation about a first axis, in the pitch direction as illustrated. A second ring structure 68 is disposed within a first ring structure 64 and rotatably thereto by at least one actuator 70 such that the second ring 68 can be selectively rotated about a second axis. If the linkage arm 62 is rotatably connected to the bogey 18, all three degrees of rotation would be provided to the seat assembly 54. If instead the linkage arm 62 were fixedly connected to the bogey 18, either a third ring 72 or support bar 74 which would support the seat assembly 54 would be disposed within the second ring 68 and rotatably connected thereto by an actuator 76 which would provide the third degree of rotation about a third axis.

Figure 9:
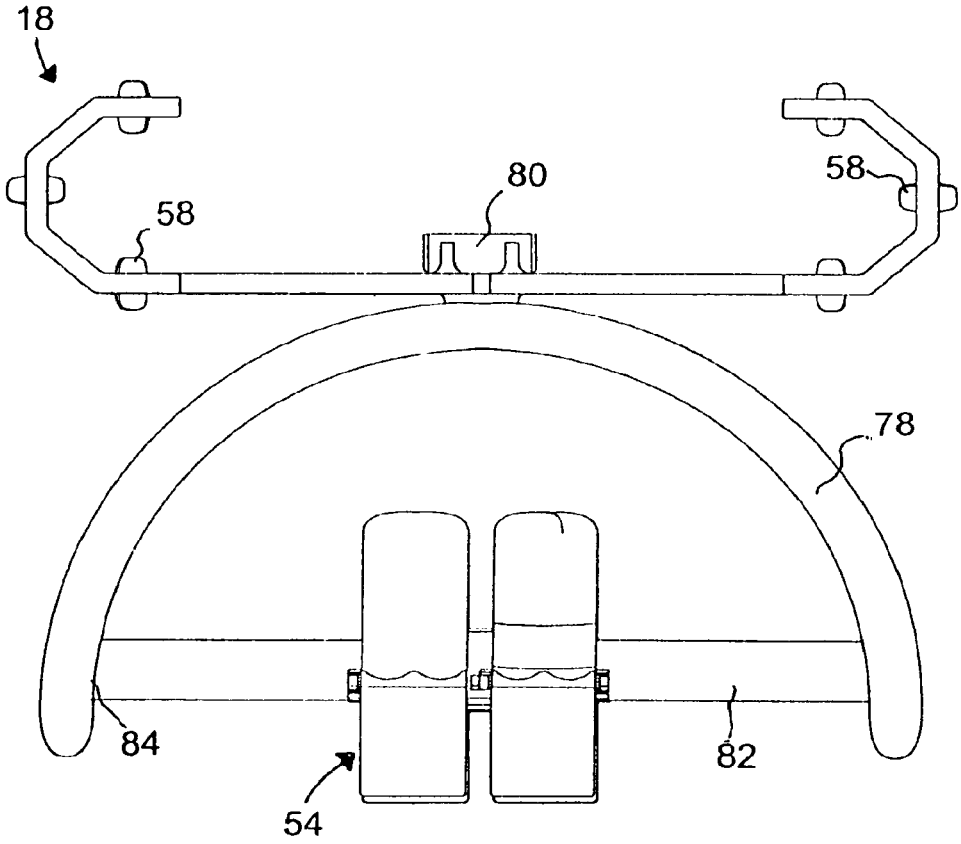
FIG. 9 is a front elevational view of yet another embodiment of the present invention.
Figure 10:
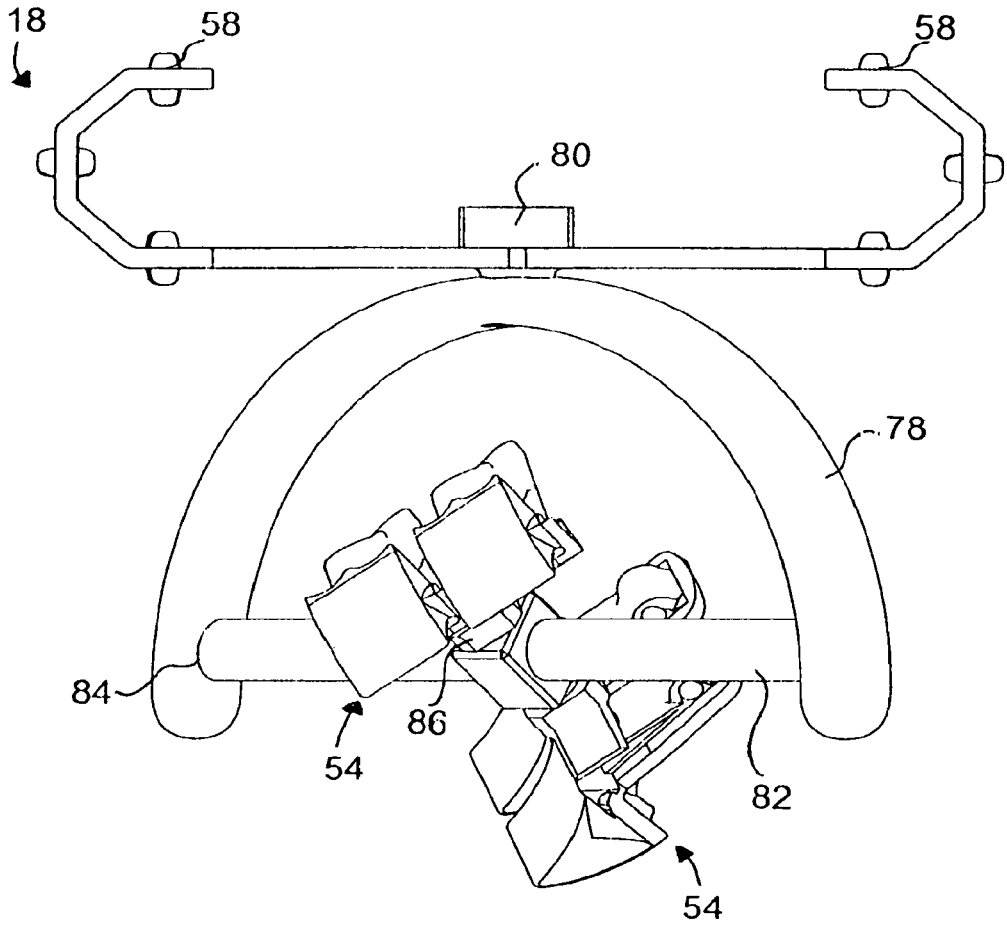
FIG. 10 is a front perspective view of the vehicle assembly of FIG. 9, illustrating rotation of the seats thereof.

With reference now to FIGS. 9-13, additional embodiments of the present invention are illustrated which accomplish the full range of motion of the seat assembly in accordance with the objectives of the present invention. With particular reference to FIGS. 9 and 10, a semi-circular boom or linkage arm 78, illustrated as a half-circular arm, is rotatably connected to the bogey 18 by an actuator 80 which provides rotation of the arm 78 about a first axis, typically in the yaw direction. A second arm 82 extends between lower ends of the linkage arm 78 and is pivotally connected thereto by an actuator such that the arm 82 rotates about a second axis, independent of the rotation of the linkage arm 78. As illustrated, the arm 82 would rotate in the pitch direction. The seat assembly 54, as illustrated in FIG. 10, is supported on the second arm 82 and interconnected thereto by another actuator 86 which serves to rotate the one or more seat assemblies 54 about yet a third axis, as illustrated in the roll direction. As described above, the actuators 80, 84 and 86 could be of any type (including electric, pneumatic, or hydraulic) which would enable the rotation of the structure.

Figure 11:
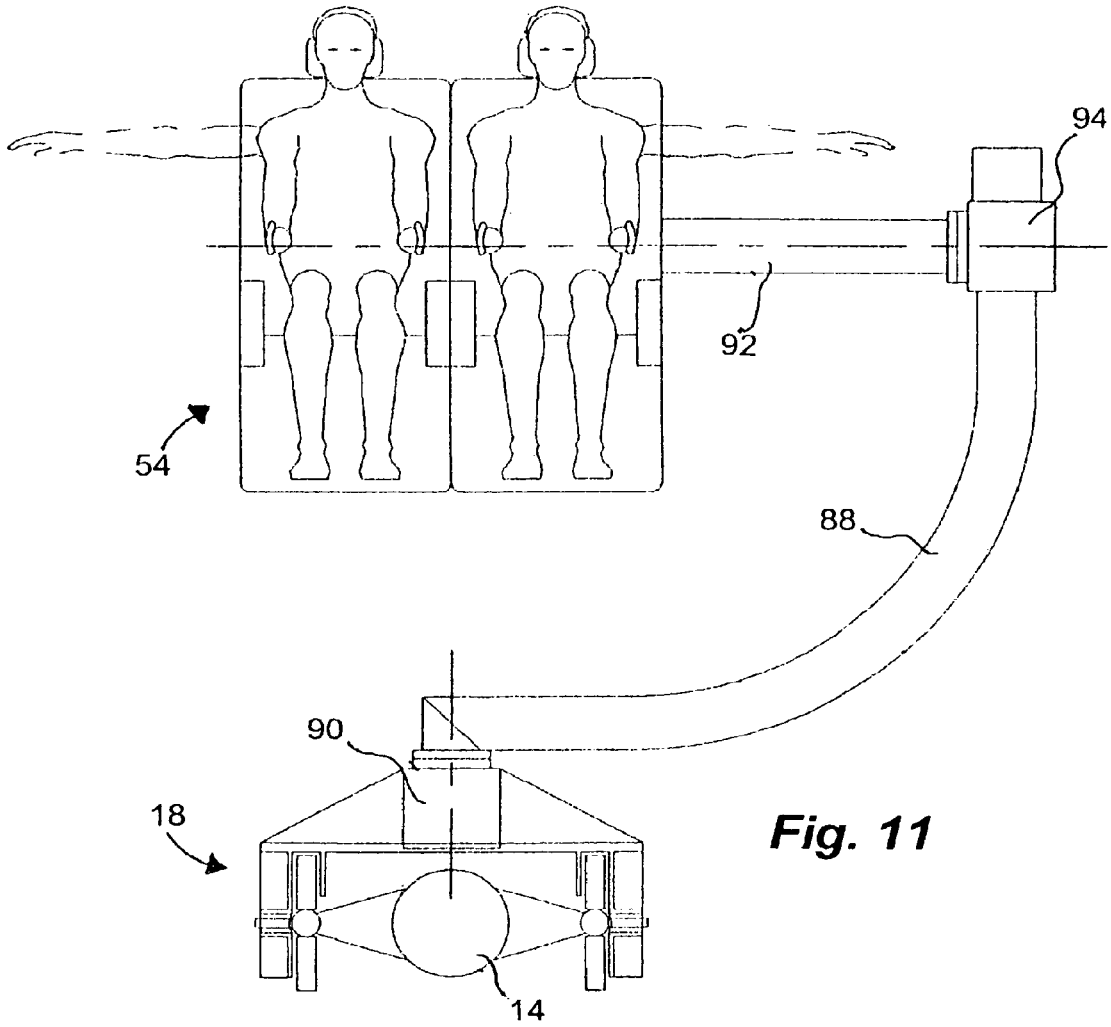
FIG. 11 is a front elevational view of yet another embodiment of the present invention.
Figure 12:
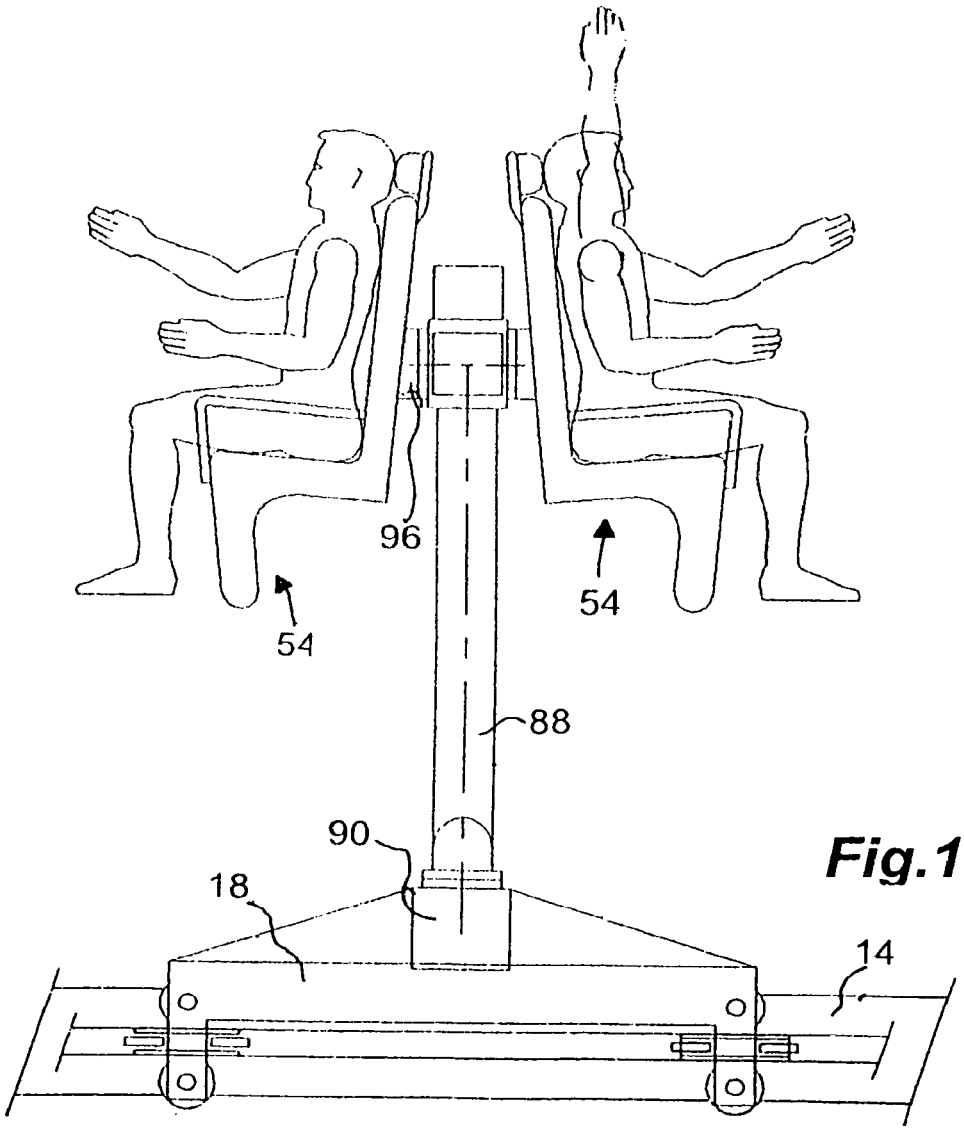
FIG. 12 is a side elevational view of the amusement ride of FIG. 11.
Figure 13:
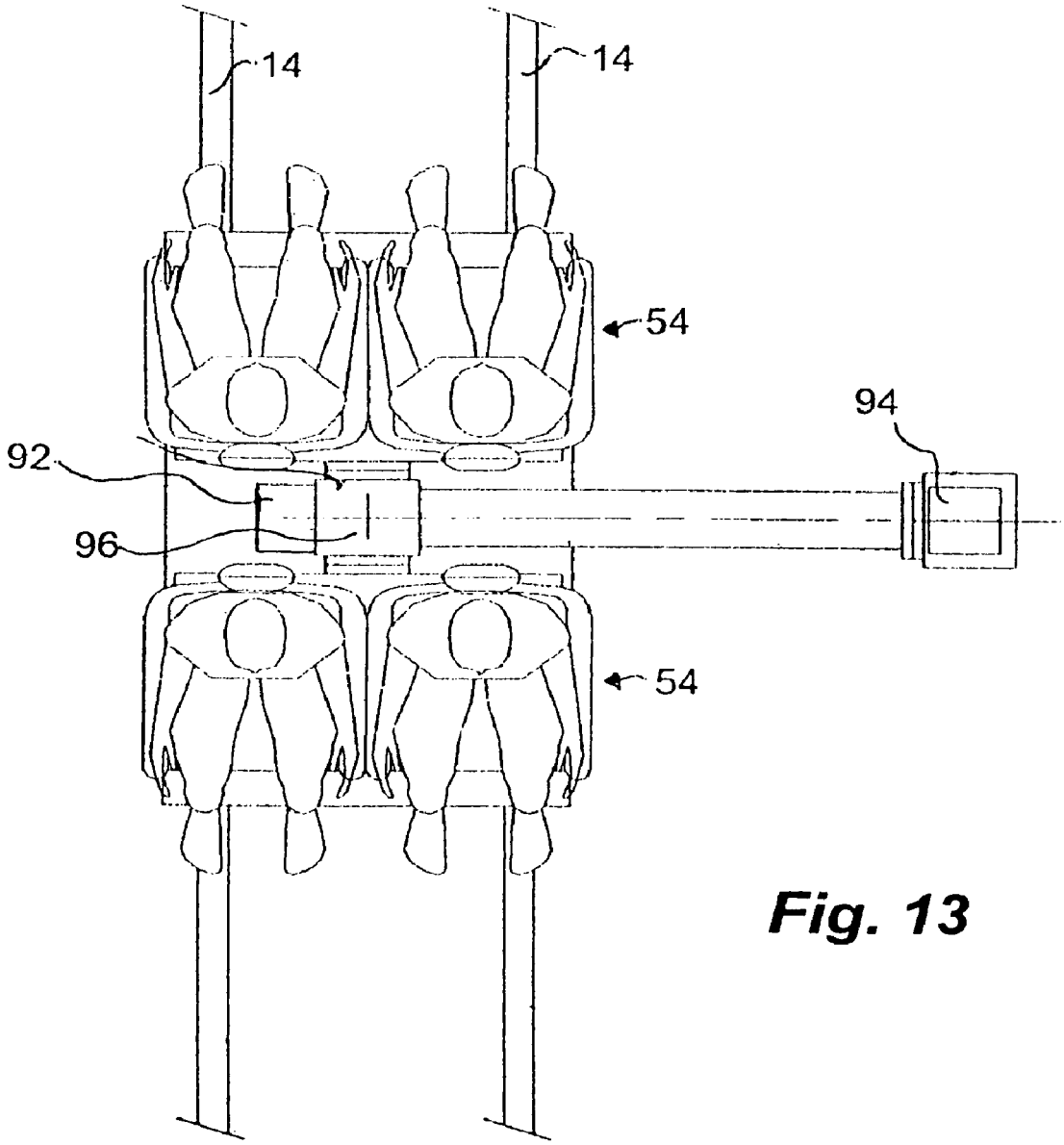
FIG. 13 is a top plan view of the amusement ride of FIGS. 11 and 12.

With reference to FIGS. 11 and 12, the first arm 88 extending from the bogey 18 is merely a quarter-circle and is connected to an actuator 90 which would rotate the arm 88 about a first axis, as illustrated in the yaw direction. Once again, a second arm 92 extends from an end portion of arm 88 and is coupled to a second actuator which would rotate the arm 92 about a second axis, as illustrated in the pitch direction. With particular reference to FIG. 12, each seat assembly 54, or even each seat 56, is connected to a third actuator 96 which provides rotation about a third axis, as illustrated in the roll direction. Thus, it will be appreciated by those skilled in the art that the linkage arm of the vehicle assembly of the present invention can take many forms to serve the purposes of the invention.

Figure 14:
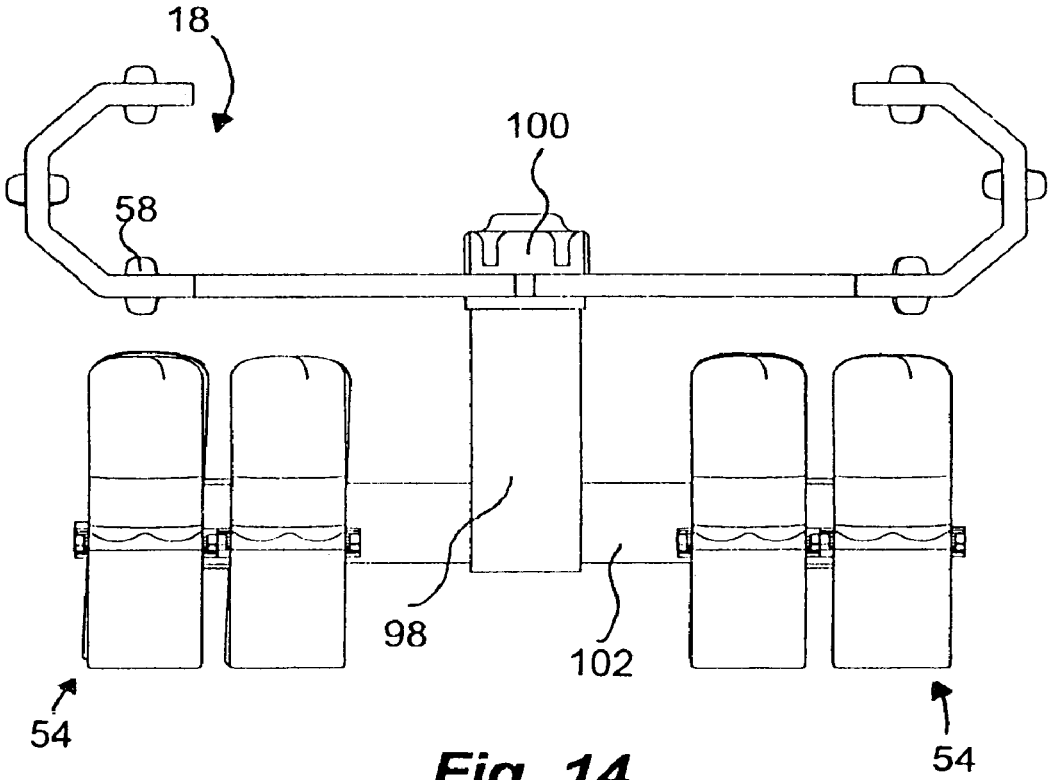
FIG. 14 is a front elevational view of yet another amusement ride embodying the present invention.
Figure 15:
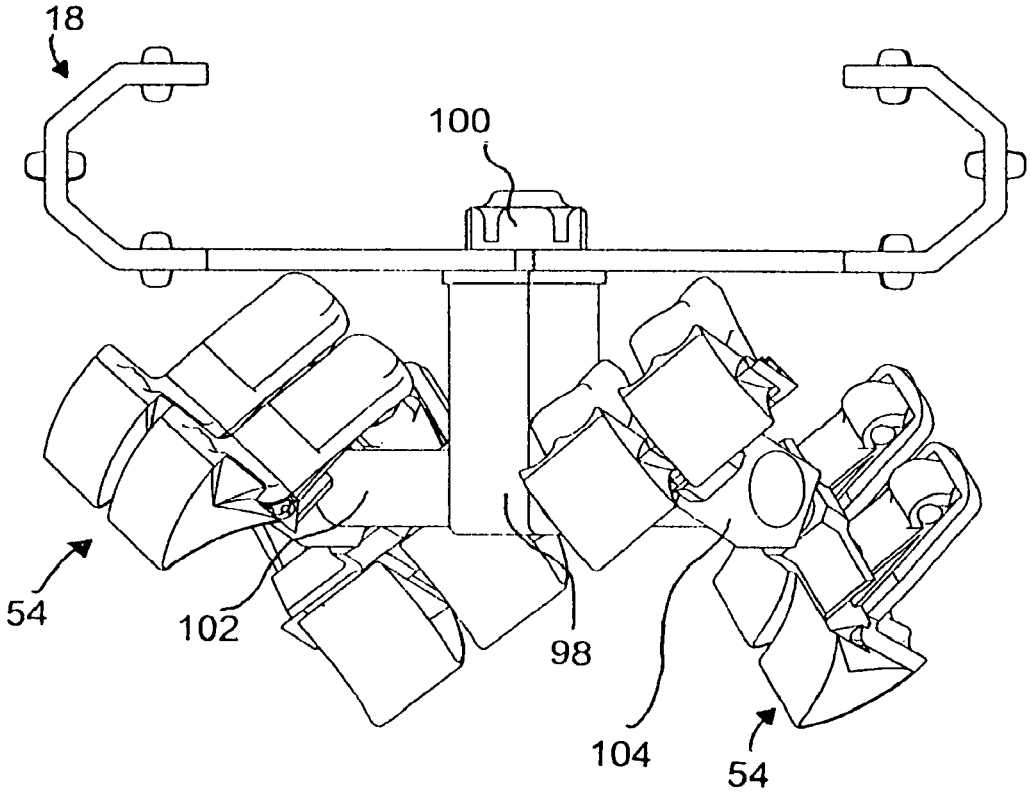
FIG. 15 is a front perspective view of the amusement ride illustrated in FIG. 14, illustrating rotation of the seats thereof in accordance with the present invention.

With reference to FIGS. 14 and 15, the first linkage arm need not be semi-circular or even angled. The linkage arm or boom 98 can be a relatively straight shaft, as illustrated in FIG. 15 and connected to the bogey 18 by a rotatable connection, such as an actuator 100. The actuator 100 illustrated in FIGS. 14 and 15 would rotate the arm 98 in a yaw direction. One or more support arms 102 could extend from the linkage arm 98 and support seats or seat assemblies 54. The inter connection of the support arm 102 and straight arm 98 would comprise an actuator such that the support arm 102 would be rotated about a second axis, in the pitch direction as illustrated. To provide a third degree of rotation, another actuator 104 would be connected to the individual seat or seat assemblies 54. This actuator 104 would then provide rotation in a third axis, in the roll direction as illustrated.

Figure 16:
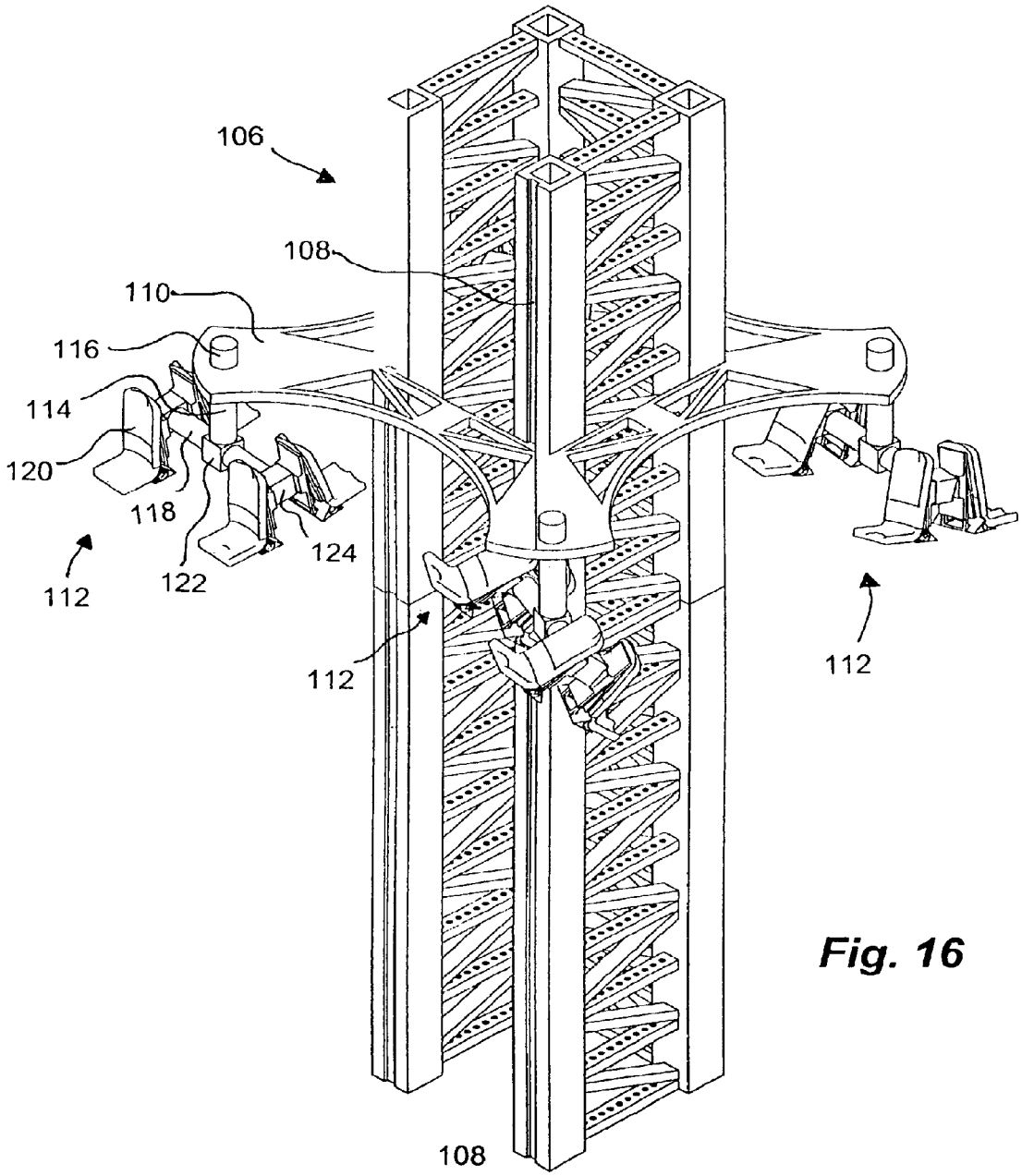
FIG. 16 is a perspective view of a vertical tower incorporating the amusement ride devices of the present invention.
Figure 17:
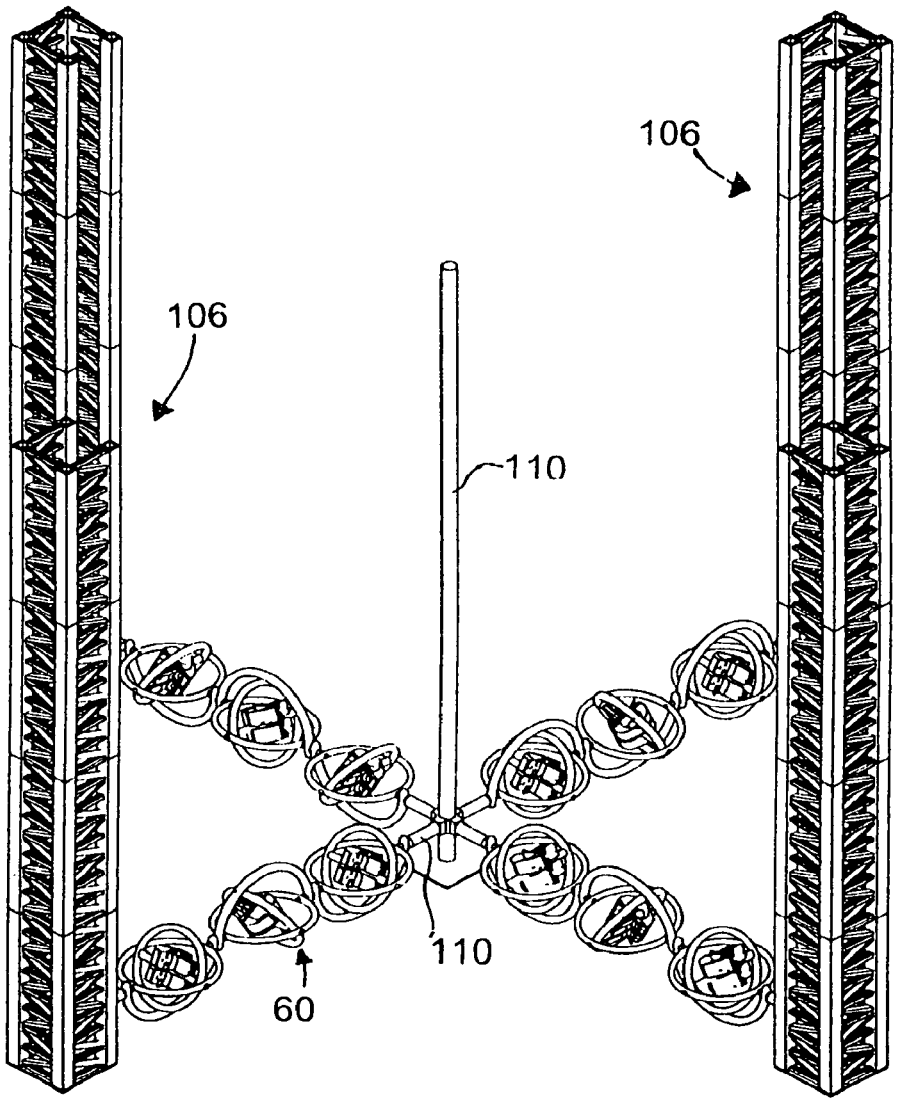
FIG. 17 is a perspective view of another vertical tower ride incorporating amusement ride devices of the present invention.

With reference now to FIGS. 16 and 17, the amusement ride of the present invention is not necessarily limited to a roller coaster 10, as described above. Rather, the amusement ride of the present invention can also be incorporated into vertical tower structures. A tower structure 106 is shown having four vertical tracks 108 coupled to or formed with the tower 10. The attachment assembly 110 operably moves along the tracks 108. Such movement can be pulley-driven, air compression driven, wheel driven, electromagnetic in nature, or any other well-known system or method for causing such attachment assemblies 110 to move in a controlled manner upwardly and downwardly about the vertical tower 106. The vehicle assemblies 112 are connected to the attachment assembly 110. Any of the forgoing illustrated and described vehicle assemblies, or any other vehicle assembly permitting at least two degrees and preferably three degrees of motion, could be utilized.

As illustrated in FIG. 16, a linkage arm 114 is connected to the attachment assembly 110. The linkage arm 114, although illustrated as extending downwardly, could instead extend upwardly, or even to the side of the attachment assembly 110. Preferably, the linkage arm 114 is rotatably connected to the attachment assembly 110, such as by a yaw actuator 116 to provide rotation of the assembly 112 about a first axis. Support arms 118 extend from the linkage arm 114 and supports the one or more seats 120 or seat assemblies. The interconnection of the linkage arm 114 and support arm 118 is preferably a rotatable connection, such as by a actuator 122, such as an electric-driven motor or gear train. In a particularly preferred embodiment, a further actuator 124 is coupled to each seat or seat assembly 120 to provide a third degree of rotation, illustrated as the roll direction. The actuators 116, 122 and 124 could be activated by sensors or more preferably by a control mechanism, such as a pre-defined program.

With reference now to FIG. 17, various configurations of such a vertical ride could be implemented. For example, the gyroscope assemblies 60 illustrated and described above could be operably linked to the attachment assembly 110 and vertical tracks 108 of the towers 106 and rotated and moved with the actuators, as described above.

It is contemplated by the present invention that individuals in either the vertical tower or roller coaster embodiments could be provided with a joy stick or control panel at an arm rest or seat thereof so as to control the degree of rotation of the riders individual seat. It is also contemplated that a system could be implemented wherein a rider upon entering the platform awaiting the boarding of the ride could utilize a touch screen monitor or the like to select the "extremeness" of their ride and thus the degree of rotation and number of rotations throughout the ride. More practically, however, the entire ride would be pre-programmed such that the seats or seat assemblies and vehicles assemblies would perform predefined rotations in sequences throughout the course of the ride. Such rotation and activation could be controlled by sensors placed along the track system or a timing mechanism or any other well-known mechanism for activating the actuators. The sensors could be repositioned or the timing adjusted such that the movement of the vehicle assemblies could be changed overtime. This could be particularly advantageous to the owner of the amusement ride as the ride experience could be changed each year in order to draw return visitors to the ride and increase ridership and thus income from the amusement ride. It is also possible that each individual vehicle assembly could have a different degree of motion than other vehicle assemblies. Thus, in a roller coaster setting, different degrees of rotation for each vehicle assembly would be known and the rider could select which vehicle assembly to board for that particular experience. A similar arrangement could be provided for the vertical tower embodiment as well.

Figure 19:
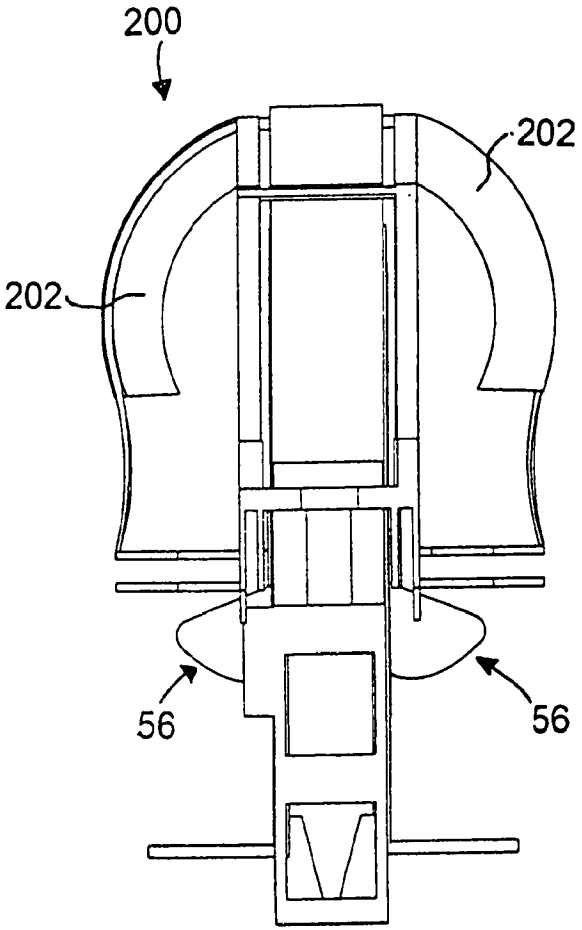
FIG. 19 is a side elevational view of the screens and vehicle assembly of FIG. 18.
Figure 18:
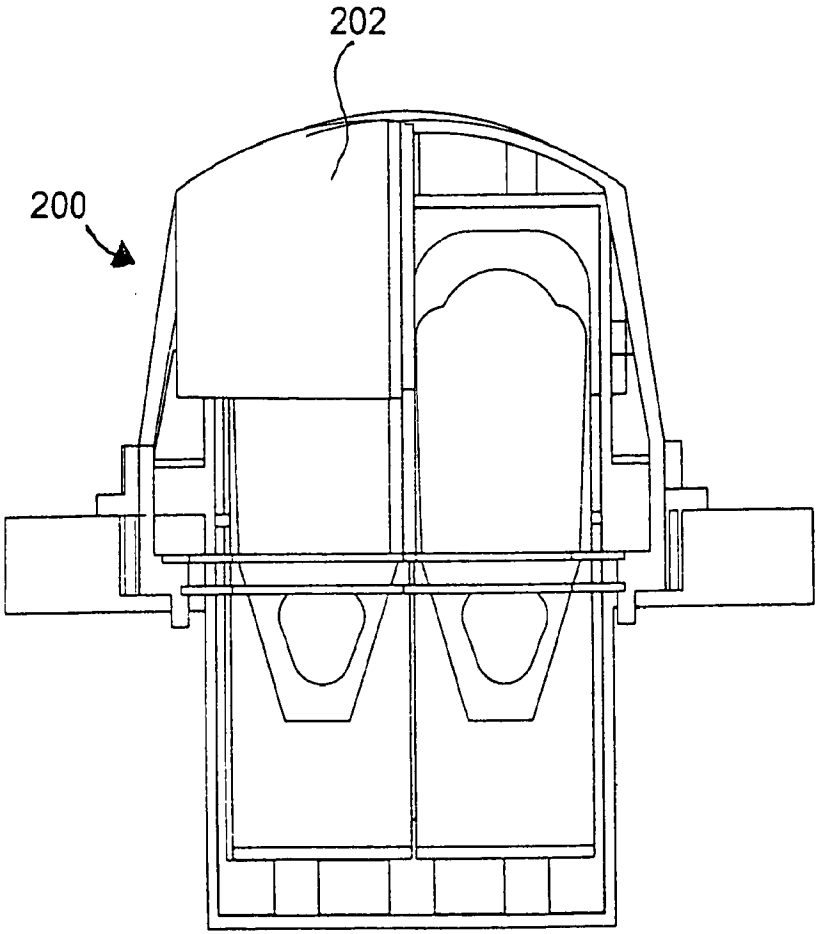
FIG. 18 is a front elevational view of a vehicle assembly of the present invention, illustrating a projection or virtual reality screen placed over seats thereof.

With reference now to FIGS. 18 and 19, each vehicle assembly, generally referred to herein by the reference number 200, could be provided with three-dimensional "virtual reality" computer generated images or other projected images on a screen 202 which would be positioned in front of the rider and the seat 56. The vehicle assembly 200 could be any of the those described above, or any other vehicle assembly which is designed and configured such so as to provide at least two degrees, and preferably three degrees of rotation of the rider. The screen 202 could comprise a projection screen, LCD, gas plasma screen, or any other device in the art of images and video. The display device can either be lowered manually or pneumatically, hydraulically, or electrically moved into place. Alternatively, the screen 202 can be formed into a pod-type unit, which would at least partially encompass the rider. Audio and visual data could be provided by any appropriate means, including CD-rom, mini disks, video tape, hard drive, DVD or other equivalent data carrier. A single screen 202 could be used for a seat assembly 54 comprising multiple seats or a pod of seats. Alternatively, individual screens 202 could be used such that each rider experiences a different virtual reality experience. The projected images could be such that the rolls, and spins performed by the ride would be in concert and synchronized with the video image projection. Different projected images could be provided to different riders, or the images could be periodically changed in all assemblies 200 over time to attract return riders.

Although several embodiments have been described in detail for purposes of illustration, various modifications may be made without departing from the scope and spirit of the invention. Accordingly, the invention is not to be limited, except as by the appended claims.

What is claimed is:

1. A roller coaster device comprising: an endless loop roller coaster track having variable elevations having at least a portion wherein a vehicle assembly is propelled by gravitational forces; said vehicle assembly secured to an attachment assembly; said vehicle assembly having an open seat assembly with one or more rider seats, said attachment assembly comprising a C-shaped boogie member operably configured to run freely along said track while being held securely thereto; said vehicle assembly including structure for full range rotation of said seat assembly about a first axis, second axis, and a third axis, where the full range rotation is independent of the track.

2. The roller Coaster as in claim 1 wherein the first axis is in a fixed position with respect to the attachment assembly and one or both of the second and third axis.

3. The roller coaster as in claim 1 wherein the first axis in a fixed position, the second axis is revolvable about the first axis, and the third axis is revolvable about the first or second axis.

4. The roller coaster as in claim 1 wherein at least one actuator on the vehicle assembly controls rotation around one or more of the first, second, and third axis.

5. The roller coaster as in claim 4 wherein the actuators are controlled by a programmable system such that the rotations about one of or more of the first, second, and third axis are defined by the programmable system.

6. The roller coaster as in claim 4 wherein the rotations about one of or more of the first, second and third axis include full range rotations.

7. The roller coaster as in claim 4 wherein the rotations about one of or more of the first, second, and third axis includes less that full range rotations.

8. The roller coaster in claim 4 wherein the actuators are controlled by sensors placed along the track.

9. The roller coaster as in claim 4 wherein the actuators are controlled by a timer.

10. The roller coaster as in claim 1 wherein rotation around one or more of the first, second, and third axis is controlled by response to changes in the acceleration of the vehicle assembly.

* * * * *